US009901946B2

(12) United States Patent
Ettlin

(10) Patent No.: US 9,901,946 B2
(45) Date of Patent: Feb. 27, 2018

(54) CARTRIDGE AND MULTICOMPONENT CARTRIDGE

(75) Inventor: Josef Ettlin, Eichberg (CH)

(73) Assignee: SULZER MIXPAC AG, Haag (CH)

( * ) Notice: Subject to any disclaimer, the term of this patent is extended or adjusted under 35 U.S.C. 154(b) by 0 days.

(21) Appl. No.: 14/236,156

(22) PCT Filed: Aug. 20, 2012

(86) PCT No.: PCT/EP2012/066191

§ 371 (c)(1),
(2), (4) Date: Jan. 30, 2014

(87) PCT Pub. No.: WO2013/056873

PCT Pub. Date: Apr. 25, 2013

(65) Prior Publication Data

US 2014/0158717 A1 Jun. 12, 2014

(30) Foreign Application Priority Data

Oct. 17, 2011 (EP) ..... 11185382

(51) Int. Cl.
*B05B 11/00* (2006.01)
*B05C 17/01* (2006.01)
(Continued)

(52) U.S. Cl.
CPC ..... *B05B 11/0054* (2013.01); *B05C 17/005* (2013.01); *B05C 17/00559* (2013.01);
(Continued)

(58) Field of Classification Search
CPC ... A61C 5/064; B05B 11/0054; B05C 17/005; B05C 17/00509; B05C 17/00553;
(Continued)

(56) References Cited

U.S. PATENT DOCUMENTS 2,887,253 A * 5/1959 Biedenstein ..... 222/327
3,311,265 A * 3/1967 Creighton, Jr. ... B05C 17/00516 222/137

(Continued)

FOREIGN PATENT DOCUMENTS

DE 019618693 A1 * 11/1997 ..... B01F 5/06
DE 19618693 A1 * 11/1997 ..... B01F 5/0615

(Continued)

OTHER PUBLICATIONS

International Preliminary Report of Patentability from the International Bureau dated May 1, 2014.

(Continued)

*Primary Examiner* — Paul R Durand
*Assistant Examiner* — Bob Zadeh
(74) *Attorney, Agent, or Firm* — Global IP Counselors, LLP

(57) ABSTRACT

A cartridge is proposed having at least one reception chamber (2), which extends in the longitudinal direction, for a medium to be dispensed, having a head part (4) and a cartridge wall (3) which bound the reception chamber (2), wherein a piston (8) is provided which can be introduced into the reception chamber (2) at the end remote from the head part (4) and which is sealingly displaceable along the cartridge wall (3) in the longitudinal direction, and wherein the cartridge wall (3) is manufactured from a cardboard and is sealingly connected to the head part (4). A multicomponent cartridge is furthermore provided by the invention.

17 Claims, 9 Drawing Sheets

Figure 1:
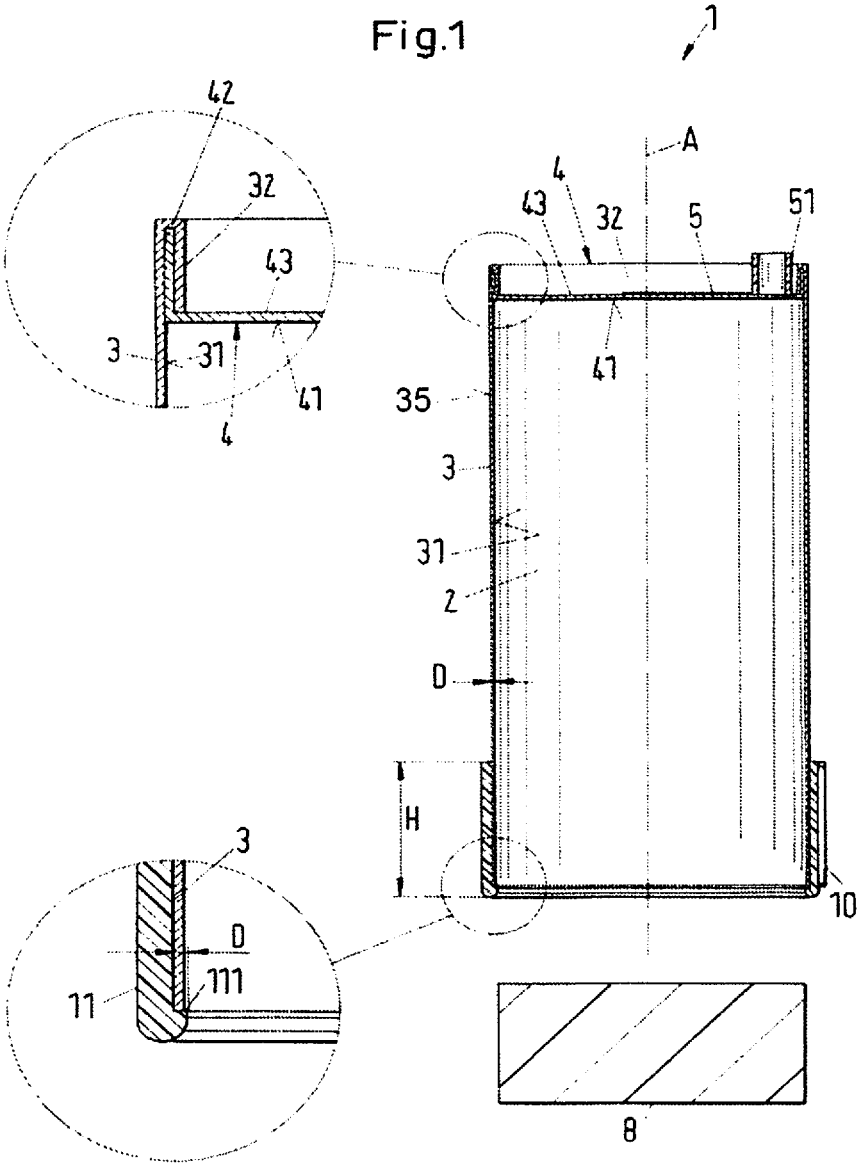

(51) Int. Cl.
*B65D 81/32* (2006.01)
*B05C 17/005* (2006.01)

(52) U.S. Cl.
CPC ..... *B05C 17/01* (2013.01); *B65D 81/325* (2013.01); *B05C 17/00509* (2013.01); *B05C 17/00553* (2013.01)

(58) Field of Classification Search
CPC ..... B05C 17/00559; B05C 17/00586; B05C 17/01; B65D 81/325; B65D 83/0005; B01F 13/0023; B01F 13/0025; B01F 13/0027; B01F 15/0205; B01F 5/0615
USPC ..... 222/137, 142.3, 142.5, 145.1, 145.5, 222/145.6, 325–327, 82
See application file for complete search history.

(56) References Cited

U.S. PATENT DOCUMENTS 3,640,431 A * 2/1972 Plumer ..... G01F 11/026 222/167
4,323,177 A * 4/1982 Nielsen ..... B65D 83/0005 222/386
4,366,919 A * 1/1983 Anderson ..... B05C 17/00513 222/137
4,371,094 A * 2/1983 Hutter, III ..... B01F 13/002 222/1
4,453,651 A * 6/1984 Braithwaite et al. ..... 222/82
4,869,403 A * 9/1989 Bruning ..... B65D 83/0005 222/327
4,946,081 A * 8/1990 Jacobson ..... B65D 35/38 222/568
5,082,147 A * 1/1992 Jacobs ..... 222/137
5,443,181 A * 8/1995 Popp ..... B05C 17/00576 222/137
5,875,928 A * 3/1999 Muller et al. ..... 222/82
5,918,772 A * 7/1999 Keller et al. ..... 222/145.6
6,634,524 B1 * 10/2003 Helmenstein ..... B05C 17/00553 222/105
8,925,764 B2 * 1/2015 Hiemer ..... 222/137
2002/0190084 A1 * 12/2002 Ichikawa et al. ..... 222/327
2003/0051610 A1 * 3/2003 Dux ..... B65D 81/325 99/495
2003/0136859 A1 * 7/2003 Borden et al. ..... 239/1
2003/0174577 A1 * 9/2003 Botrie ..... B01F 5/0613 366/340
2004/0074927 A1 * 4/2004 Lafond ..... 222/327
2004/0226968 A1 * 11/2004 Lafond ..... 222/327
2005/0057637 A1 * 3/2005 Brugner ..... 347/171
2010/0330525 A1 * 12/2010 Grundler et al. ..... 433/36

FOREIGN PATENT DOCUMENTS

EP 0 721 805 A2 7/1996
JP 7 256178 A 10/1995
JP 07256178 * 10/1995 ..... B05C 5/00
WO WO2010/020060 * 2/2010 ..... B05C 17/005

OTHER PUBLICATIONS

International Search Report for International Patent Application No. PCT/EP2012/066191 dated Feb. 15, 2013.
Written Opinion for International Patent Application No. PCT/EP2012/066191 dated Feb. 15, 2013.

* cited by examiner

CARTRIDGE AND MULTICOMPONENT CARTRIDGE

PRIORITY CLAIM

The present application is a National Stage of International Application No. PCT/EP2012/066191, filed on Aug. 20, 2012, which claims priority to European Patent Application No. 11185382.6 filed on Oct. 17, 2011, the entire contents of which are being incorporated herein by reference.

The invention relates to a cartridge having at least one reception chamber, which extends in the longitudinal direction, for a medium to be dispensed as well as a multicomponent cartridge in accordance with the preamble of the respective independent claim.

In the industrial sector, in the construction industry, for example of buildings, and also in the dental sector, cartridges are frequently used to store liquid or flowable substances, frequently pasty or viscous to highly viscous substances and to dispense them for the respective application as required. Examples for such substances are caulking compounds, materials for chemical dowels or chemical anchors, adhesives, pastes or impression materials in the dental sector. These cartridges are usually produced from plastic and are manufactured in an injection molding process.

A distinction is made between single-component systems in which the material to be dispensed is only made of one component and two-component or multicomponent systems in which at least two different components are stored in separate chambers of the same cartridge or in separate cartridges, wherein the components are intimately mixed on dispensing by means of a dynamic or static mixing apparatus. Examples for this are two-component adhesives or chemical dowels which only harden after the mixing of the two components. Two-component systems are in particular also used in the industrial sector for paints which are often used to generate functional protective layers such as for corrosion protection. It is frequently the case that the cartridges include one or more axially displaceable conveying pistons by whose movement the material is dispensed from the chamber or chambers. It is understood that for this purpose the chambers have to have sufficiently thick walls in order to be able to withstand the pressure arising on the dispensing. In addition, the cartridges have to have sufficiently substantial wall thicknesses to be sufficiently diffusion-resistant. This is in particular important with respect to the storage to prevent a diffusing in or a diffusing out of the chemical substances and thus a degradation of the cartridge content as effectively as possible. Since such plastic cartridges are as a rule only designed for a single use, a substantial amount of waste results both with regard to volume and to mass, which has to be disposed of and which is in particular also disadvantageous under aspects of environmental protection.

In addition to the aspect of environmental protection, the topic of sustainability is also increasingly gaining importance. The use of renewable starting materials, the minimization of the use of raw materials and energy as well as a reduction of waste which is as high as possible or the disposal of the waste in as unproblematic a manner as possible are increasingly gaining importance both with regard to the cartridge per se and to the volume of residual material remaining in the cartridge.

it is therefore an object of the invention to provide a cartridge which represents an improvement with regard to sustainability and environmental protection. A high operational security and a good storability of the cartridge should be ensured in this respect. Furthermore, a corresponding multicomponent cartridge should be made possible by the invention.

The subjects of the invention satisfying this object are characterized by the features of the independent claims of the respective category.

In accordance with the invention, a cartridge is therefore proposed having at least one reception chamber, which extends in the longitudinal direction, for a medium to be dispensed, having a head part and a cartridge wall which bound the reception chamber, wherein a piston is provided which can be introduced into the reception chamber at the end remote from the head part and which is sealingly displaceable along the cartridge wall in the longitudinal direction, and wherein the cartridge wall is manufactured from a cardboard and is sealingly connected to the head part. The term cardboard also includes cardboard composite materials.

It has surprisingly been found that a cartridge whose cartridge wall is manufactured from cardboard is very suitable with respect to storability, operational reliability and simple operation for the applications in which plastic cartridges are usually used today. The use of cardboard is in particular a great advantage with respect to sustainability. The use of natural, regenerative raw materials such as cellulose fibers in the cardboard allows an environmentally compatible use of resources and an inexpensive environmentally friendly disposal.

Since moreover cardboard can be designed as stable from the aspect of its mechanical properties, the cartridge in accordance with the invention provides the advantages of a conventional cartridge with respect to its filling and its storability; it therefore does not have to be filled in complex and/or expensive filling apparatus as is as a rule necessary for hoses and can be stored substantially more easily, for example also standing.

The piston provided for dispensing the medium from the reception chamber has the advantage that smaller residual material volumes remain in the cartridge as a rule, whereby the waste amount is reduced. Furthermore, with chemical media in the reception chamber, risks caused by the chemistry of the individual components not reacted out are minimized. The piston is preferably designed as a valve piston or as a self-bleeding piston so that a simple bleeding during the use of the piston is possible.

To increase the portion of natural raw materials even more, it is preferred if the head part is manufactured from a cardboard.

It is in particular preferred with respect to the storability when the cartridge wall or the head part—in particular preferably both—include a film which is provided at the surface of the cartridge wall or of the head part bounding the reception chamber and which is non-releasably connected to the cartridge wall or to the head part. The film represents a very efficient diffusion barrier so that no concessions have to be made on the storability or on the maximum storage time. The cartridge contents are even effectively protected against the diffusing in or out of substances or a "degassing" with longer storage times. In addition the cartridge wall or the head part is protected by the film, e.g. when the cardboard material of the cartridge wall is sensitive to the medium in the reception chamber. The film furthermore brings along a very high flexibility with respect to the material selection and can be adapted to the specific cartridge contents depending on the application. It is a further advantage of the film that it reduces the friction between the cartridge wall and the piston on the dispensing of the medium.

It is in particular possible with the design with film to reduce the cartridge wall in comparison with conventional cartridges because the wall thickness is no longer required as a means to avoid or reduce diffusion-induced degradation processes. Such designs are preferred in which the cartridge wall has a wall thickness of at most 1.0 mm, preferably of approximately 0.5 mm. This small wall thickness means a very substantial reduction of waste and a reduction of the raw materials required for the manufacture in comparison with conventional cartridges. In order to be able better to withstand the mechanical strains on the dispensing despite the small wall thickness, the cartridge in accordance with the invention is preferably placed into a reusable supporting cartridge on the dispensing of its contents or a dispensing apparatus is used in which the supporting function is directly integrated. Even larger wall thicknesses can naturally also be realized depending on the application, for example for large-volume cartridges. The cartridge wall can also be designed to be so thick that no supporting cartridge or similar is required for the dispensing.

It can be advantageous depending on the application for the cartridge wall to have a second film which is provided at the outer surface of the cartridge wall remote from the reception chamber. This second film can be used, for example, as protection from mechanical influences or for lettering, in particular to characterize the cartridge contents.

An advantageous measure is that the film of the cartridge wall or of the head part—preferably both—is designed as a multilayer system. It is namely hereby possible to adapt the film ideally to the respective application. The properties of the film serving as a barrier or as a diffusion barrier can be used in a targeted manner to make it as efficient as possible with respect to the medium in the reception chamber. Such a multilayer system is preferably designed as a composite film. The multilayer system can also include metallic layers.

In a preferred embodiment, a fixed shape supporting ring is provided which surrounds the cartridge wall from the outside at the end of the reception chamber intended for the reception of the piston. This supporting ring is in particular advantageous with respect to the storage since it improves the seal between the cartridge wall and the piston. The supporting ring can be reusable.

It is advantageous in this respect for the supporting ring to include an undercut which supports the cartridge wall with respect to the longitudinal direction. After the insertion of the piston into the reception chamber, it is secured by the undercut.

In a preferred embodiment, connection means are provided at the cartridge by means of which the cartridge can be connected to a second cartridge. These connection means can in particular be designed as a latch connection or a click connection or snap-in connection. The connection means are preferably arranged so that the two cartridges can be connected side by side next to one another so that their longitudinal directions or longitudinal axes extend parallel to one another. Connection means with which the cartridges can be connected so that the one cartridge is arranged in the other cartridge are likewise preferably coaxial so that the longitudinal axes of the two cartridges coincide. The possibility of connecting a plurality of cartridges to one another via the connection means considerably increases the flexibility with respect to the areas of application because the cartridges can in particular be used very easily for multicomponent systems. The supporting ring is in particular suitable to provide connection means there.

In a preferred embodiment, the head part includes an adapter which has an outlet for the medium. The cartridge becomes particularly flexible with respect to its uses due to this adapter because the adapter can be adapted so that it can cooperate with various accessory parts without modifications at other parts of the cartridge being necessary for this purpose.

In this respect, the adapter is preferably produced from plastic—in particular injection molded—and is connected to the head part. This connection can be releasable or non-releasable. The adapter and the head part can naturally also be in one piece, for example manufactured in a single injection molding process. In the case of a separate adapter, the adapter can, for example, be adhesively bonded to the head part or be welded thereto or be injection molded onto the head part after its manufacture in an injection molding process. The adapter is then a separate component whose design and/or positioning can be adapted to the respective application without changes to the rest of the cartridge. It is in particular possible to manufacture the head part of the cartridge with a surface completely closed to the outside—that is initially without an outlet for the medium—so that the medium in the reception chamber cannot exit outwardly and is protected in storage. The adapter which includes the inlet is positioned on the head part, with the outlet not yet having any flow connection with the reception chamber. The head part of the cartridge is then only pushed through the outlet for use so that the medium can exit through the outlet. The pushing through can optionally also be dispensed with, e.g. when the head part bursts itself due to a sufficiently large inner pressure or by means of assistance of a (cutting) edge.

A multicomponent cartridge is furthermore provided by the invention having at least two cartridges, of which at least one cartridge is designed in accordance with the invention, wherein the two cartridges are arranged next to one another with respect to the longitudinal direction or wherein the two cartridges are arranged in one another, preferably coaxially in one another, so that the one cartridge surrounds the other cartridge. In the first variant, it is a question of so-called side-by-side cartridges in which the two reception chambers are arranged next to one another. In the second variant, the two cartridges are arranged in one another so that the cartridge wall of the outer cartridge completely surrounds the cartridge wall of the inner cartridge. In this respect, the inner cartridge is preferably centered in the outer cartridge so that their longitudinal axes A coincide. Coaxial cartridges are then spoken of. The area of application of the cartridge in accordance with the invention can be expanded to include two-component and multicomponent systems by this multicomponent cartridge.

The two cartridges are preferably fixedly connected to one another via the connection means so that the multicomponent cartridge forms a unit capable of storage and dispensing.

It is a particularly advantageous measure for the adapter of the cartridges to be arranged and designed for cooperating with an accessory part, in particular with a mixer. It is, for example, possible in this manner to use accessory parts known per se in conjunction with the multicomponent cartridge. This compatibility is advantageous for practical and economic reasons.

In accordance with a preferred embodiment, the multicomponent cartridge includes a mixer which is designed for cooperating with the adapters and has two piercing elements of which each can engage into an outlet to open a flow connection with the respective reception chamber. The multicomponent cartridge can be opened in a particularly simple manner by this measure.

To increase the flexibility of the multicomponent cartridge with respect to the areas of use and the applications, the reception chambers of the two cartridges can have different volumes so that in particular mixing ratios between the two media contained in the reception chambers of the cartridges can be realized which differ from a ratio of 1:1.

Further advantageous measures and embodiments of the invention result from the dependent claims.

Figure 2:
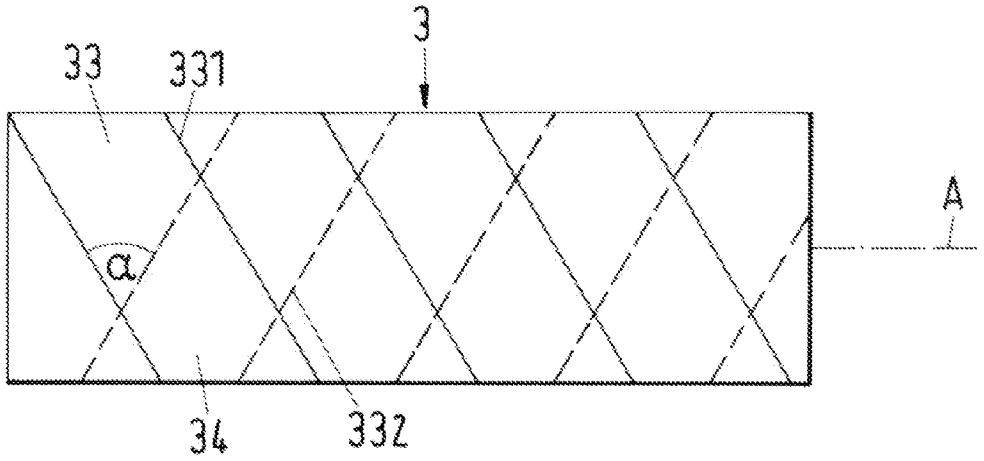
Figure 3:
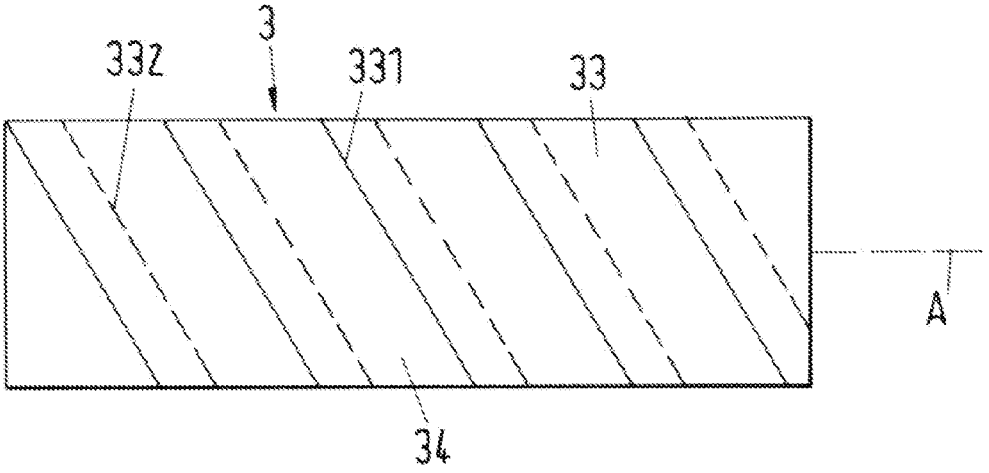
Figure 4:
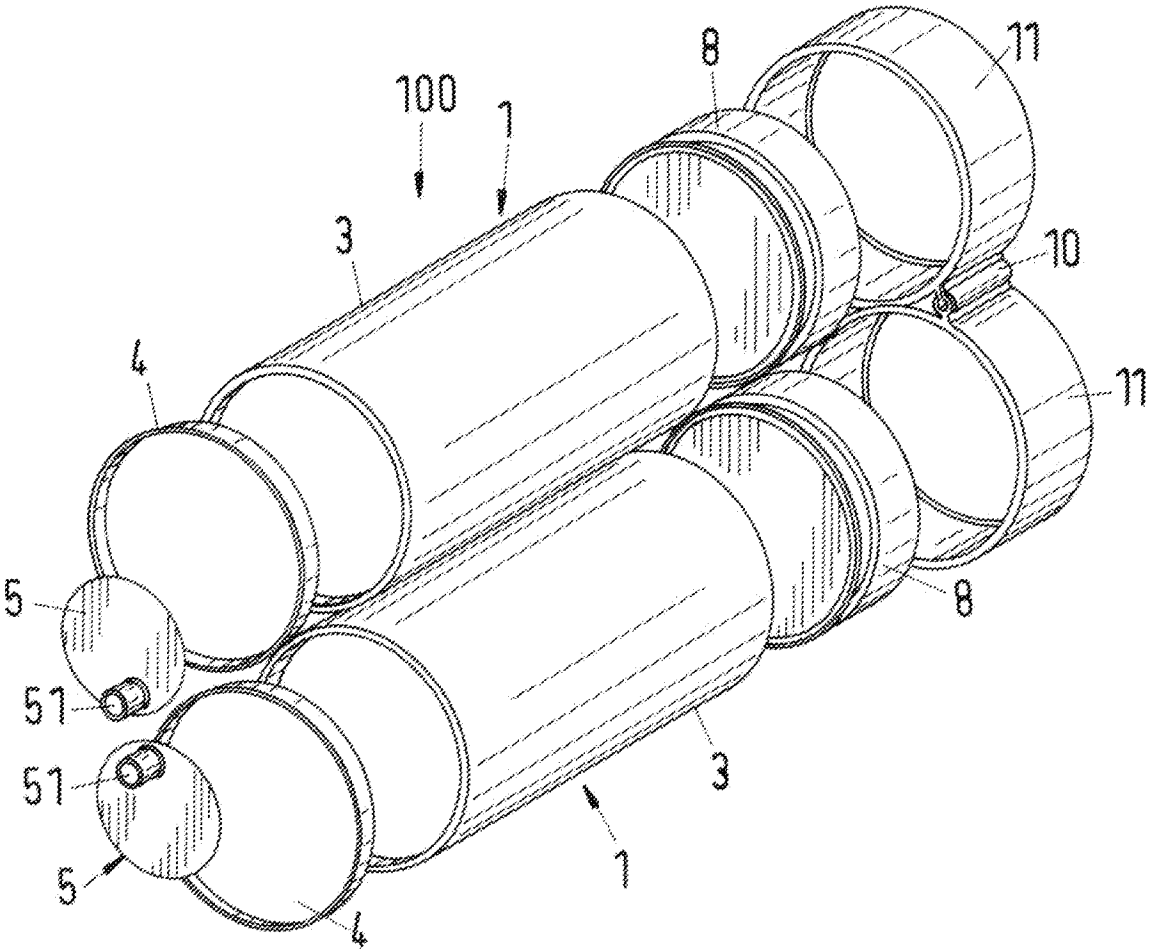
Figure 5:
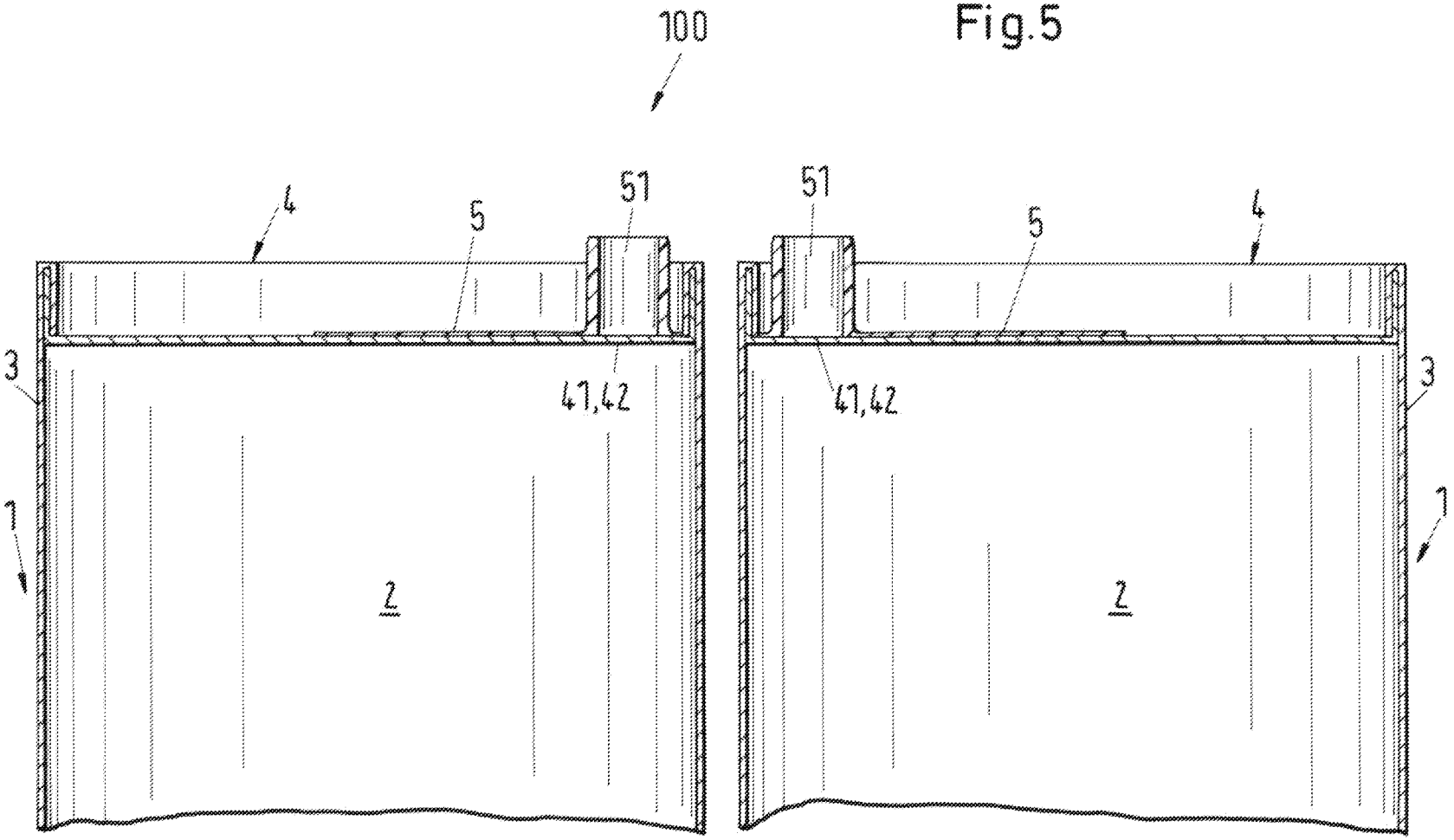
Figure 6:
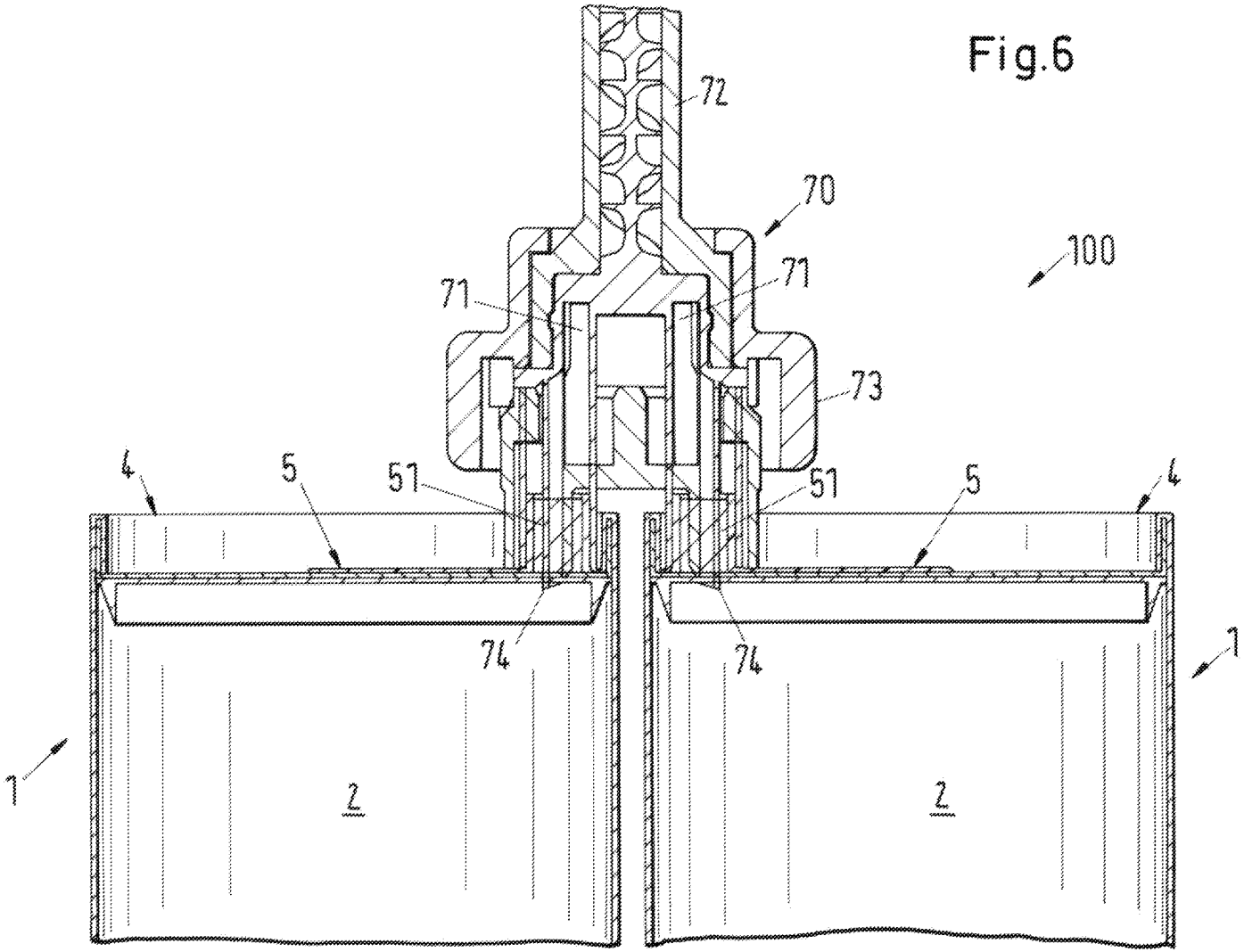
Figure 7:
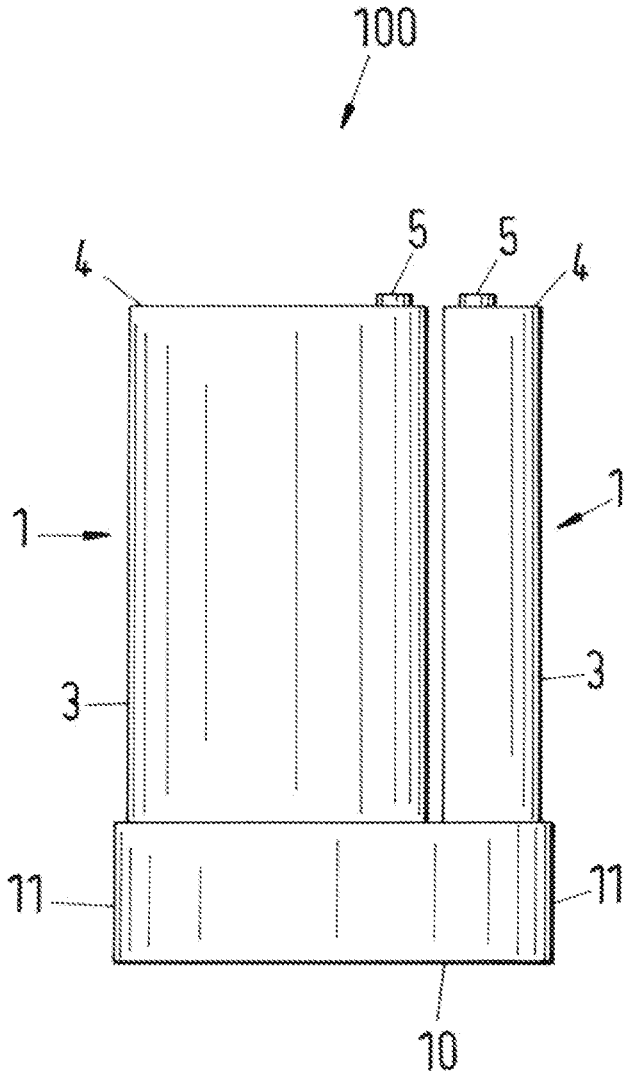
Figure 8:
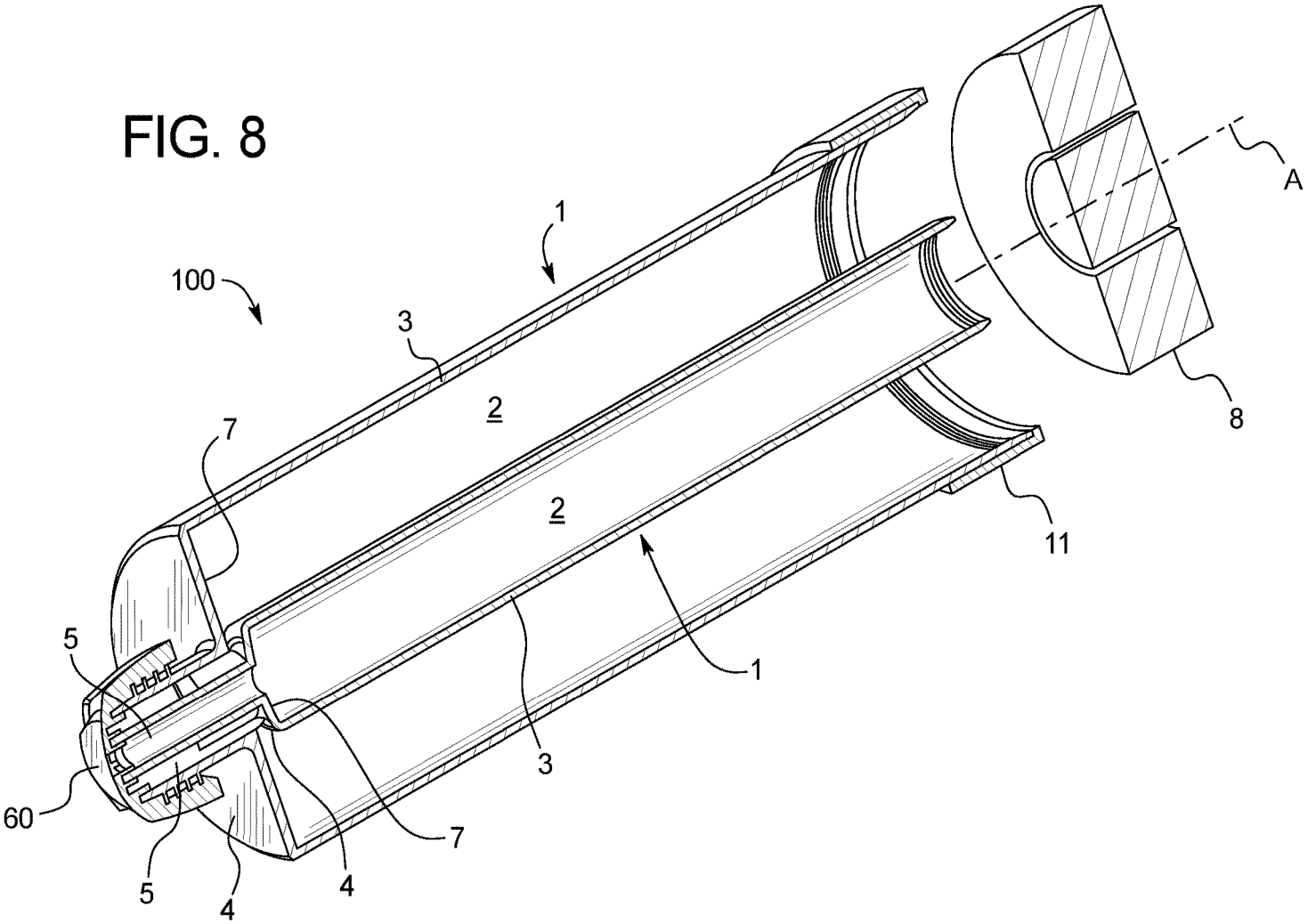
Figure 9:
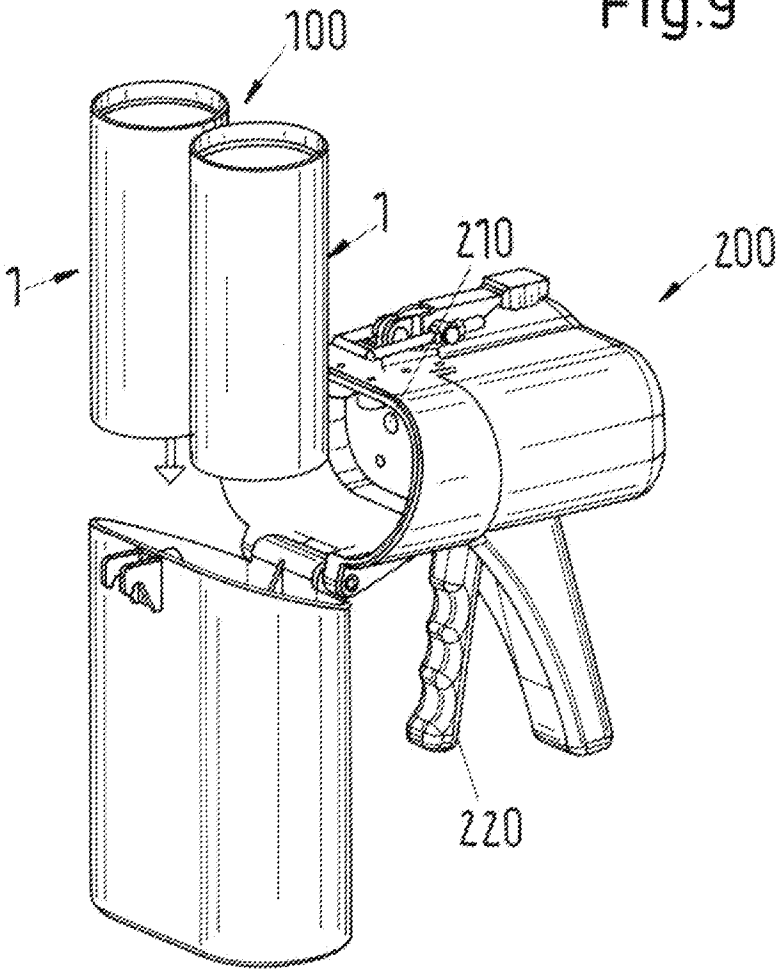
Figure 10:
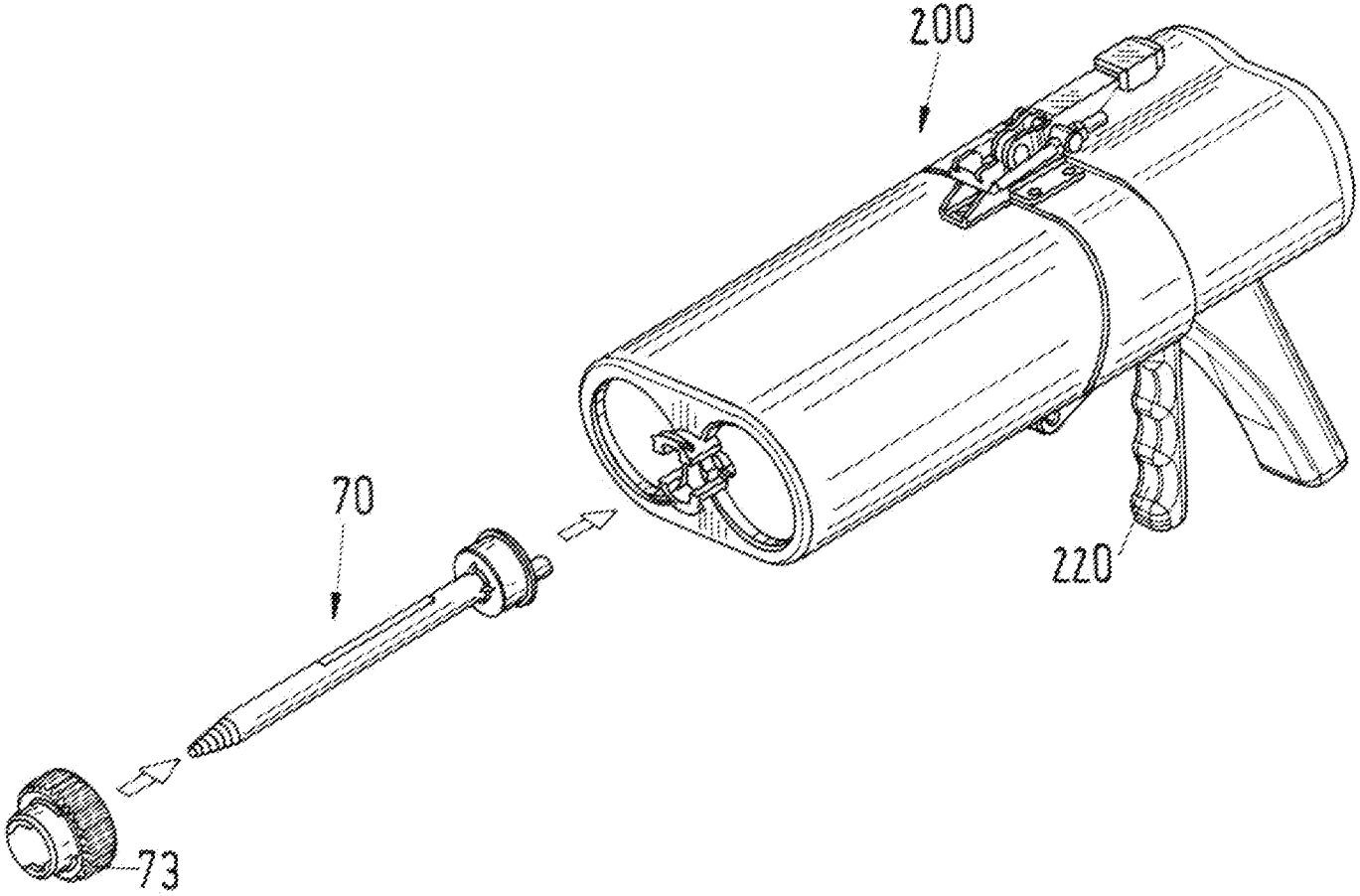

The invention will be explained in more detail in the following with reference to embodiments and to the drawing. There are shown in the schematic drawing, partly in section:

FIG. 1: an embodiment of a cartridge in accordance with the invention in a longitudinal section with two detail representations;

FIG. 2: a schematic representation of a variant for the cartridge wall;

FIG. 3: a schematic representation of another variant for the cartridge wall;

FIG. 4: a perspective exploded representation of a first embodiment of a multicomponent cartridge in accordance with the invention;

FIG. 5: a representation of the outlets of the embodiment of FIG. 4;

FIG. 6: a representation of the outlets of the embodiment with a mixer placed on (only shown in part);

FIG. 7: a view of a second embodiment of a multicomponent cartridge in accordance with the invention;

FIG. 8: a view of a third embodiment of a multicomponent cartridge in accordance with the invention; and FIGS. 9-10: representations of a dispensing apparatus which is suitable for the cartridge in accordance with the invention and for the multicomponent cartridge in accordance with the invention.

FIG. 1 shows in a longitudinal section a first embodiment of a cartridge in accordance with the invention which is designated as a whole by the reference numeral 1. The cartridge 1 includes a reception chamber 2, which extends in the longitudinal direction, for a medium to be dispensed. The longitudinal direction is defined by the longitudinal axis of the cartridge 1 designated by A. The reception chamber 2 is bounded by a cartridge wall 3 as well as by a head part 4. A piston 8 is furthermore provided which can be introduced into the reception chamber 2 at the end remote from the head part 4 and which has not yet been inserted into the reception chamber 2 in FIG. 1, but is shown outside thereof. The piston 8 is preferably designed as a valve piston or as a self-bleeding piston. The piston 8 is designed and dimensioned so that it is sealingly displaceable along the cartridge wall 3 in the longitudinal direction. For this purpose, the piston 8 can be designed in a manner known per se with sealing lips or sealing margins, not shown, which contact the cartridge wall 3 when the piston 8 is introduced into the reception chamber 2.

The piston 8 is manufactured separately from the cartridge 1, for example in an injection molding process and is usually only inserted after the filling of the reception chamber 2.

The reception chamber 2 of the cartridge 1 is cylindrical in design, that is the cartridge wall 3 is the jacket surface of a cylinder. The head part 4 of the cartridge 1 has an adapter 5 of plastic, for example polyethylene (PE) (see also FIG. 4) which has an outlet 51 for the medium. The outlet 51 is here provided as a projecting tube at the adapter 5. The adapter 5 is non-releasably connected to the head part 4, for example welded or adhesively bonded.

In accordance with the invention, the cartridge wall 3 is manufactured from a cardboard and is sealingly connected to the head part 4. In this respect, the term cardboard means a material based on cellulose fibers or cellulose or groundwood pulp or recovered paper or combinations thereof which usually, but not necessarily, includes a plurality of layers of paper or board of different thickness and/or different material. These layers are frequently pressed with one another without the use of adhesive. One or both sides of the cardboard can be coated or painted in this respect. Cardboard materials are also known which are made of a plurality of adhesively bonded layers. The usual grammage of cardboard amounts to between 150 and 600 g/m$^2$, with the invention not being restricted to this weight range.

Due to the use of regenerative raw materials in the form of cardboard, the cartridge in accordance with the invention satisfies the demands of environmental compatibility and sustainability to a particularly high degree.

The head part 4 is therefore likewise manufactured from a cardboard in a preferred embodiment. FIG. 1 shows in the top detail view a possibility of how the head part 4 made from cardboard can be sealingly connected to the cartridge wall 3. For this purpose, the head part 4 includes a cover 43 of disk shape which has a margin 42 at its radially outer end which extends upwardly in the longitudinal direction A in accordance with the representation and which extends along the total periphery of the cover 43. This margin 42 thus extends parallel to the cartridge wall 3 with respect to the longitudinal direction. The margin 42 and the cover 43 are in one piece, that is the margin 42 arises by folding or creasing. The head part 4 is dimensioned so that the margin 42 contacts the cartridge wall 3 over the full periphery. After the head part 4 has been inserted in an inwardly disposed manner into the circular opening formed by the cartridge wall 3, an upper region 32 of the cartridge wall 3 is kinked over or folded downwardly in accordance with the representation, that is by approximately 180°, so that the margin 42 of the head part 4 is captured between the cartridge wall 3 and its upper region 32. In this respect, the margin 42 is preferably adhesively bonded, welded or otherwise sealingly connected to the cartridge wall 3 or its upper region. Other possibilities of the connection between the head part 4 and the cartridge wall 3 are naturally also possible. The head part 4 can thus, for example, project over the cartridge wall 3. The head part can be connected to the cartridge wall by folding the outer margin of the head part in the longitudinal direction.

The cover 43 is designed as a disk and in particular has no openings by which the medium could move out of the reception chamber 2 into the outlet 51. The outlet 51 therefore has no flow connection with the reception chamber 2. The cover 43 is only opened through the outlet 51 directly before application in that the cover 43 is pierced by a sharp-edged or acute article. Alternatively, a cover can also be used having a passage opening, with the passage opening being closed up to use, e.g. by a closure plug.

The cartridge wall 3 and the head part 4 each include a film 31 or 41 respectively which are each provided at the surface of the cartridge wall 3 and of the head part 4 bounding the reception chamber 2. The film 31 extends over the total cartridge wall 3, including the upper region 32, that is in particular over the total inner side of the cylinder jacket, which bounds the reception chamber 2, and is non-releasably connected, preferably adhesively bonded or welded, to the cartridge wall 3. The film 41 extends over the total circular surface of the head part 4, including the margin 42, and is non-releasably connected, preferably adhesively bonded or welded, to the head part 4. Optionally, a further film 35 can additionally be provided at the outer surface of the cartridge wall 3 remote from the reception chamber 2.

The films 31 and 41 serve as a barrier or as a diffusion barrier which prevents the diffusing in or diffusing out of substances. These substances can, for example, be chemical components of the medium contained in the reception chamber 2 or can be moisture or oxygen. The films 31, 41 thus allow a particularly long storability of the cartridge 1 filled with a medium. Since the films 31,41 act as a barrier layer or as a diffusion barrier, it is possible, for example, to design the cartridge wall 3 with a thickness D which is much smaller than with known cartridges since in the cartridges known from the prior art a larger wall thickness has to be provided so that the cartridge is sufficiently diffusion-resistant or is protected against degassing. It is in particular possible with the films 31, 41 to manufacture the cartridge wall 3 with a thickness D of at most 1.0 mm, preferably of approximately 0.5 mm.

If the thickness D of the cartridge wall 3 is reduced or made small, the advantageous effect results that considerably less raw material is required for the manufacture of the cartridge 1 and that the waste amount of the cartridge 1 usually designed for single use is considerably reduced both with respect to volume and to weight.

The second advantageous effect of the film 31 is that it reduces the friction between the piston 8 and the cartridge wall 3. The piston 8 is moved in the direction of the longitudinal axis A during the application for dispensing the medium from the reception chamber 2 to convey the medium through the outlet 51. The film 31 in this respect enables an easier sliding of the piston 8 along the cartridge wall 3.

The two films 31, 41 can be—but do not have to be—designed as of the same type with respect to their thickness and their composition.

Each of the films 31, 41 can be ideally adapted to the respective application. Depending on the composition and on the type of the medium in the reception chamber 2, the films 31, 41 can be designed so that they ensure an ideal storability and an ideal protection of the cartridge wall 3 and of the head part 4. The medium in the reception chamber 2 namely does not even come into contact at all with the cardboard of the cartridge wall 2 or of the head part 4 due to the films 31, 41. It hereby becomes possible to use a particularly inexpensive material or a particularly environmentally friendly material for the manufacture of the cartridge.

A preferred measure is for the films 31, 41 each to be designed as a multilayer system, that is, for example, to be formed from a plurality of films or layers placed over one another. These different layers of the films 31, 41 can have different functions. A protective layer which is made of a plastic not sensitive to the medium to be dispensed, for example polyamide (PA) or polybutylene terephthalate (PBT) can, for example, be on the side facing the reception chamber 2. This can optionally be adjoined by a barrier layer which prevents the exit or entrance of substances such as water, oxygen or VOCs (volatile organic compounds). A filler layer, which is made e.g. of recyclate, can then follow. Layers of a polyolefin such as PE or PP can also be provided, or metallic layers.

Additionally or alternatively, foamed films can also be provided as layers.

A fixed shape supporting ring 11 which surrounds the cartridge wall 3 over the full periphery from the outside is furthermore provided at the end of the cartridge wall 3 at which the piston 8 is introduced. The term "fixed shape" means that the supporting ring does not change its shape during normal use and can be at most elastically deformed without substantial exertion of force. The supporting ring 11 has an axial height H in the direction of the longitudinal axis A which substantially corresponds to the axial height of the piston 8. After the piston 8 has been inserted into the reception chamber 2, the supporting ring 11 supports the cartridge wall 3 in the region in which the piston 8 is located. A high sealing effect is hereby ensured between the cartridge wall 3 and the piston 8, in particular also during the storage of the filled cartridge 1.

The supporting ring 11 is sealingly and non-releasably connected to the cartridge wall 3. This can take place by an adhesive bonding or welding of the supporting ring 11 and of the cartridge wall 3. It is naturally also possible to connect the supporting ring 11 releasably to the cartridge wall, for example, by plugging the supporting ring 11 on. The supporting ring 11 is in particular reusable in such embodiments.

It can be advantageous if the supporting ring 11 has an undercut 111 which can be recognized in the lower detail representation of FIG. 1. The undercut is provided at the lower margin of the supporting ring in accordance with the representation and is designed so that the cartridge wall 3 can be supported on the undercut 111 at its axial end—the lower end in accordance with the representation—with respect to the longitudinal direction. The undercut 111 projects inwardly a little beyond the cartridge wall 3 in the radial direction with respect to the plane perpendicular to the longitudinal direction. If the piston 8 is now introduced, it snaps over the undercut 111 and is subsequently supported by it.

The cartridge 1 furthermore has connection means 10 by means of which the cartridge 1 can be connected to a second cartridge 1. In the embodiment described here, the connection means 10 are provided at the supporting ring 11 of the cartridge 1. The connection means 10 are preferably designed in a manner known per se as a click connection or as a snap-in connection or as a latching connection and are arranged so that two cartridges 1 are arranged side by side, that is with parallel longitudinal axes A, next to one another (see e.g. FIG. 4). Alternatively or additionally, connection means can naturally also be arranged along the cartridge wall 3.

As already mentioned, the head part 4 is preferably manufactured from cardboard, but can also be made from plastic. An injection molding process is preferred for the manufacture of such a head part 4, of the adapter 5, of the piston 8 and of the supporting ring 11. All plastics known per se and used for cartridges are suitable in this respect, for example polyamides (PA), polypropylene (PP), polyethylene (PE), polybutylene terephthalate (PBT) or polyolefins in general, optionally with fiber reinforcement.

The cartridge wall 3 manufactured from cardboard has the shape of a cylindrical tube. A rectangular piece of cardboard, optionally coated with the film 31 and/or the film 35, can be bent to form a cylindrical tube and then adhesively bonded or welded to the slightly overlapping ends for the manufacture, for example. This can, however, result in problems with leak tightness depending on the application because this welding seam or adhesive bonding seam or the overlap at which the two ends are adhesively bonded or welded, forms a projection or an offset on the inner surface of the cartridge wall 3 which results in unwanted leakage on the sliding along of the piston 8. Such embodiments are therefore preferred in which the inner surface of the cartridge wall 3 is free of projections or beads.

Such a variant for the manufacture of the cartridge wall 3 as a cylindrical tube is illustrated in FIG. 2. The cartridge wall 3 includes at least two layers of cardboard which lie over one another and which are each made of at least one cardboard strip 33 and 34 respectively (shown in chain dotting). Each cardboard strip 33, 34 is respectively inclined to the longitudinal axis A, wound about it, and indeed so that the individual windings each abut. No overlap is therefore present between adjacent windings of the cardboard strip 33 and 34 respectively. The abutting edges are designated by 331 and 332 respectively in FIG. 3. The lower layer in accordance with the representation is formed by the cardboard strips 34 shown by chain dotting having the abutment edges 332; the upper layer in accordance with the representation is formed by the cardboard strip 33 having the abutment edges 331. In the variant shown in FIG. 2, the two layers are wound so that the lower layer is inclined in the opposite way to the longitudinal axis A than the upper layer, that is the individual webs of the cardboard strip 33 extend from the top left to the bottom right in accordance with the representation, while the webs of the cardboard 34 extend from the top right to the bottom left. The abutment edges 331 of the upper layer form an acute angle $\alpha$ with the abutment edges 332 of the lower layer.

In the layers which are not directly adjacent to the reception chamber 2, that is in the outer layers, the adjacent windings of the cardboard strip 34 can also be arranged slightly overlapping to improve the leak tightness.

Another variant is shown in FIG. 3. The difference from the variant shown in FIG. 2 is that the two cardboard strips 33 and 34 are wound with the same inclination toward the longitudinal axis A, but are offset from one another. The individual windings of the two cardboard strips 33, 34 are also each placed abutting one another here. However, the abutment edges 331 of the upper layer here extend parallel to the abutment edges 332 of the lower layer.

Both variants have the advantage that no overlap arises between adjacent webs because they extend end to end. It is ensured in this respect by the different inclination of the webs of the two layers (FIG. 2) or by the offset between the webs of the two layers (FIG. 3) that the abutment edges 331 and 332 respectively of the one layer are covered by the respective other layer so that leak problems are efficiently avoided.

The cartridge 1 is first manufactured without the piston 8 and the adapter 5 adhesively bonded on or fastened. The reception chamber 2 is closed by the cover 42 and the film 41 of the head part 4 with respect to the outlet 51. The medium is filled into the reception chamber 2 from the still open end of the reception chamber 2 at the bottom in accordance with the representation (FIG. 1). The piston 8 is subsequently inserted into the reception chamber 2 and then forms the chamber base which sealingly closes the reception chamber 2. The piston 8 is frequently designed as a valve piston so that, on the insertion of the piston 8, the air which may be present between the component and the piston can be removed in a simple manner.

It is also possible to design the cartridge 1 so that it manages without adapter or without the protruding tube which forms the outlet 51. The head part 4 produced from plastic or cardboard can thus, for example, be partially punched out, with the film 41 closing the reception chamber 2 before use. A mixer is then inserted into this punching and its outlet pierces the film 41 for use.

FIG. 4 shows a perspective representation of a first embodiment of a multicomponent cartridge in accordance with the invention which is designated as a whole by the reference numeral 100. The multicomponent cartridge includes at least two cartridges 1 of which each is designed in accordance with the invention.

The first embodiment of the multicomponent cartridge 100 in accordance with the invention includes two cartridges 1 of which each is designed as a cartridge 1 in accordance with the invention.

In the following, reference will be made with an exemplary character to the case of special importance for practice that the multicomponent cartridge 100 is a two-component cartridge which includes exactly two cartridges 1. It is, however, understood that the invention is not restricted to such cases, but that the multicomponent cartridge can also include three or more cartridges.

The two cartridges 1 of the multicomponent cartridge 100 are arranged side by side next to one another so that their longitudinal axes A (see FIG. 1) extend parallel to one another.

The two cartridges 1 of the first embodiment (FIG. 4) are preferably fixedly connected to one another via the connection means 10. It is, however, also possible that the two supporting rings 11 of the cartridges 1 are manufactured in a common injection molding process and are then fixedly connected to one another via elements not releasable without destruction so that the two-component cartridge is in one piece with respect to the supporting rings 11. The same can also apply to the adapter or adapters 5.

A respective piston 8 is provided for each of the two cartridges 1 and is introduced into the reception chamber 2 after the filling of the respective reception chamber. The two adapters 5 with the outlets 51 of the cartridges 1 are arranged and designed so that they are suitable for cooperating with an accessory part.

FIG. 5 shows the end of the multicomponent cartridge 1 provided with the adapters 5 and the two outlets 51 in a larger representation. It is in principal not necessary to provide the two outlets 51 in the adapters 5 with a closure part because the respective medium in the reception chambers 2 is protected from diffusion processes and from a running out by the films 41 and optionally by the covers 42 of the head parts 4. It is, however, understood, that additional closure means can be provided.

FIG. 6 shows the adapters 5 or the outlets 51 with an accessory part, namely with a mixer 70. In this respect, it is a static mixer 70 for mixing the two media which are present in the respective reception chambers 2 of the two cartridges 1. The static mixer 70 includes in a manner known per se a mixer tube 72, only indicated in FIG. 6, with mixing elements (not shown) arranged therein. The mixer 70 furthermore includes two inlets 71 as well as one coupling piece 73. If the mixer 70 is placed onto the multicomponent cartridge 100, each of the separate inlets 71 engages into or over one of the outlet passages 51 so that the inlets 71 each form a flow connection with one of the outlets 51 and the respective medium moves from the respective reception chamber 2 through the respective outlet 5 into the mixer 70. The two media meet one another here and are mixed intimately with one another on passing through the mixer 70.

It is understood that the cartridge in accordance with the invention or the multicomponent cartridge in accordance with the invention can also be designed for other accessory parts, in particular for other types of mixers, for example such mixers which do not have any separate inlets for the media.

All types of connection known per se, in particular screw connections, snap-in connections or bayonet connections, are suitable for the connection of the mixer 70 to the multicomponent cartridge 100 via the coupling piece 73.

To pierce or cut through the cover 42, and optionally the film 41, of the head part 4 prior to use, the mixer 70 has a respective piercing element 74 at each of its inlets 71 which engages into one of the outlets 51 to open a flow connection with the respective reception chamber 2. A variant for realizing the piercing elements 74 is that the inlets 71 of the mixer—or corresponding parts of another accessory part—are designed at their ends cooperating with the outlets 51, for example with an oblique edge or a mandrel, such that the inlets 71 pierce the cover 42 and the film 41 or open them in another manner on the placing on of the mixer 70.

FIG. 7 shows the view of a second embodiment of a multicomponent cartridge 100 in accordance with the invention. Only the differences from the first embodiment will be looked at in more detail in the following. The explanations which were made with respect to the first embodiment also apply in correspondingly the same manner to the second embodiment.

In the second embodiment, the multicomponent cartridge is designed for material ratios differing from 1:1 and includes two cartridges 1, with the reception chambers 2 of the two cartridges 1 having different volumes. Such multicomponent cartridges 100 are intended for such two-component systems in which the two components should be mixed with one another in a volume ratio different from 1:1. In the multicomponent cartridge 100 shown in FIG. 7, the cartridge 1 at the left in accordance with the illustration has ten times the volume as the cartridge 1 at the right in accordance with the illustration. Other ratios are naturally also realizable, for example 2:1 or 4:1.

The connection means 10 are also provided between the two cartridges 1 between the two supporting rings 11 in the multicomponent cartridge 100 shown in FIG. 7.

FIG. 8 shows a perspective longitudinal sectional representation of a third embodiment of a multicomponent cartridge 100 in accordance with the invention. Only the differences from the first and second embodiments will be looked at in more detail in the following. The explanations which were made with respect to the first and second embodiments also apply in correspondingly the same manner to the third embodiment. In the third embodiment, the two cartridges 1 are arranged in one another so that the cartridge wall 3 of the outer cartridge 1 in accordance with the representation completely surrounds the cartridge wall 3 of the inner cartridge 1 in accordance with the representation. In this respect, the inner cartridge is preferably centered in the outer cartridge so that their longitudinal axes A coincide. This means that in a section through the two reception chambers 2 perpendicular to the common longitudinal axis A, the two cartridge walls 3 of the inner and outer cartridges 1 form concentric circles around the longitudinal axis A. Such multicomponent cartridges 100 are usually called coaxial cartridges and are sufficiently known per se to the skilled person so that they do not require any further explanation, in accordance with the invention, each of the two cartridges 1, namely both the inner cartridge 1 and the outer cartridge 1, each have a cartridge wall 3 which is manufactured from a cardboard. As shown in FIG. 8, piston 8 belonging to the outer cartridge 1 in accordance with the representation is in this respect designed in a manner known per se as a ring piston.

Alternatively, it is also possible to provide an arrangement as in the third embodiment in which only one cartridge 1 designed in accordance with the invention is provided and the second cartridge is manufactured from plastic. It is, for example, possible in an arrangement analog to the third embodiment to design the inner cartridge 1 as a plastic tube so that only the outer cartridge has a cartridge wall produced from cardboard. It is naturally also possible only to manufacture the inner cartridge in accordance with the invention with a cartridge wall from cardboard and to produce the outer cartridge from plastic. The use of the two-component or multicomponent cartridge 100 will now be explained with reference to FIGS. 9 and 10, with the explanations applying in correspondingly the same manner to all embodiments. To use the two-component cartridge 100, it is usually inserted into the holder of a dispensing apparatus (dispenser) 200. Since the multicomponent cartridge 100 is designed with thin cartridge walls 3, the holder of the dispensing apparatus is preferably designed so that it additionally exerts a supporting function onto the cartridge walls 3 to assist them on the dispensing of the medium so that the multicomponent cartridge 100 can better withstand the mechanical strain on the dispensing. Alternatively, a separate supporting cartridge can also be used which is designed for multiple use, that is can be used as often as required. The supporting cartridge filled with the multicomponent cartridge 100 is then placed into the holder of the dispensing apparatus 200.

In the embodiment of the dispensing apparatus 200 described here with integrated supporting function (that is without a separate supporting cartridge), the multicomponent cartridge 100 is placed into the holder of the dispensing apparatus 200, as the arrow without reference symbol in FIG. 9 indicates. The dispensing apparatus is closed and a mixer 70 is fastened to the dispensing apparatus 200 by means of its coupling piece 73 (FIG. 10), preferably using a screw connection a snap-in connection or a bayonet connection. It is, however, also possible that the mixer 70 is not fastened to the dispensing apparatus 200, but is fastened directly to the adapters 5 of the multicomponent cartridge. If the mixer 70 is placed onto the adapters 5, the piercing elements 74 pierce the head parts 4 so that the two media can move through the outlets 51 into the mixer 70. It is naturally also possible to pierce the head parts 4 with a separate tool before the placing on of the mixer 70 and then to use a mixer without piercing elements. It is also possible, for example by applying pressure, to open the outlets by a bursting.

The dispensing apparatus 200 includes a double plunger 210 which can be moved forward by means of an activator 220. The double plunger 210 then exerts a force onto the two pistons 8 in the reception chambers 2, whereby they are displaced along the longitudinal axes A of the cartridges 1 and convey the respective medium through the respective outlet 51 into the static mixer 70. The two media (components) meet one another here and are mixed intimately with one another on passing through the mixer.

The invention claimed is:

1. A cartridge comprising:

at least one reception chamber configured to dispense a medium and extending in a longitudinal direction, the at least one reception chamber having a head part and a cardboard cartridge wall sealingly connected to the head part, the cartridge wall and the head part bound the at least one reception chamber;

a piston configured to be received by the at least one reception chamber at a first end of the at least one reception chamber opposite a second end adjacent to the head part, the piston being sealingly displaceable along the cartridge wall in the longitudinal direction; and a supporting ring surrounding the cartridge wall at the first end of the at least one reception chamber, and configured to radially support the cartridge wall so as to maintain a seal between the cartridge wall and the piston during storage, the supporting ring being located within a same axial region as the piston with respect to a longitudinal axis of the cartridge in a state in which the cartridge is filled with the medium from the first end, and the supporting ring being disposed adjacent an exterior of the cartridge wall substantially entirely along a length of the supporting ring the supporting ring including an undercut supporting the cartridge wall in the longitudinal direction and the piston configured to snap over the undercut and to be supported by the undercut.

2. The cartridge in accordance with claim 1, wherein the head part is a cardboard member.

3. The cartridge in accordance with claim 1, further comprising a first film non-releasably connected to one of an inner surface of the cartridge wall and an inner surface of the head part.

4. The cartridge in accordance with claim 3, wherein the first film is disposed on one of the cartridge wall and the head part to form a multilayer structure.

5. The cartridge in accordance with claim 1, further comprising a second film non-releasably connected to an outer surface of the cartridge wall.

6. The cartridge in accordance with claim 1, wherein the undercut is configured to secure the piston upon insertion into the at least one reception chamber.

7. The cartridge in accordance with claim 1, further comprising a connection member connecting the cartridge to a second cartridge.

8. The cartridge in accordance with claim 1, wherein the head part includes an adapter having an outlet for the medium.

9. The cartridge in accordance with claim 8, wherein the adapter is a plastic member and is connected to the head part.

10. The cartridge in accordance with claim 1, wherein the supporting ring is a rigid member configured to enable passage of a piston therethrough into the at least one reception chamber without changing the structure of the supporting ring.

11. The cartridge in accordance with claim 1, wherein the supporting ring is reusable.

12. A multicomponent cartridge comprising:

at least two cartridges, at least one cartridge of the at least two cartridges comprising at least one reception chamber configured to dispense a medium and extending in a longitudinal direction, the at least one reception chamber having a head part and a cardboard cartridge wall sealingly connected to the head part, the cartridge wall and the head part bounding the at least one reception chamber, a piston configured to be received by the at least one reception chamber at a first end of the at least one reception chamber opposite a second end adjacent to the head part, the piston being sealingly displaceable along the cartridge wall in the longitudinal direction, and a supporting ring surrounding the cartridge wall at the first end of the at least one reception chamber, and configured to radially support the cartridge wall so as to maintain a seal between the cartridge wall and the piston during storage, the supporting ring being located within a same axial region as the piston with respect to a longitudinal axis of the cartridge in a state in which the cartridge is filled with the medium from the first end, and the supporting ring being disposed adjacent an exterior of the cartridge wall substantially entirely along a length of the supporting ring the supporting ring including an undercut supporting the cartridge wall in the longitudinal direction and the piston configured to snap over the undercut and to be supported by the undercut, the at least two cartridges having an arrangement such that the at least two cartridges are arranged adjacent to one another with respect to the longitudinal direction.

13. The multicomponent cartridge in accordance with claim 12, wherein the at least two cartridges are fixedly coupled by a connection member.

14. The multicomponent cartridge in accordance with claim 12, further comprising at least one adapter arranged and configured to cooperate with an accessory part, the accessory part being a mixer.

15. The multicomponent cartridge in accordance with claim 14, wherein the adapter includes an outlet that is configured to cooperate with piercing elements of the mixer to open a flow connection to the at least one reception chamber.

16. The multicomponent cartridge in accordance with claim 12, wherein the at least two cartridges each include a reception chamber, each reception chamber being configured to receive mediums of different volumes.

17. A multicomponent cartridge comprising:

at least two cartridges, at least one cartridge of the at least two cartridges comprising at least one reception chamber configured to dispense a medium and extending in a longitudinal direction, the at least one reception chamber having a head part and a cardboard cartridge wall sealingly connected to the head part, the cartridge wall and the head part bounding the at least one reception chamber, a piston configured to be received by the at least one reception chamber at a first end of the at least one reception chamber opposite a second end adjacent to the head part, the piston being sealingly displaceable along the cartridge wall in the longitudinal direction, and a supporting ring surrounding the cartridge wall at the first end of the at least one reception chamber, and configured to radially support the cartridge wall so as to maintain a seal between the cartridge wall and the piston, the supporting ring being located within a same axial region as the piston with respect to a longitudinal axis of the cartridge in a state in which the cartridge is filled with the medium from the first end, and the supporting ring being disposed adjacent an exterior of the cartridge wall substantially entirely along a length of the supporting ring the supporting ring including an undercut supporting the cartridge wall in the longitudinal direction and the piston configured to snap over the undercut and to be supported by the undercut, the at least two cartridges having a coaxial arrangement such that the at least two cartridges are arranged in one another with one cartridge surrounding the other cartridge.

* * * * *